US011466966B2

(12) United States Patent
Ben Ami et al.

(10) Patent No.: US 11,466,966 B2
(45) Date of Patent: Oct. 11, 2022

(54) LASER INTERCEPTOR FOR LOW-FLYING AIRBORNE DEVICES

(71) Applicants: THE STATE OF ISRAEL ISRAEL NATIONAL POLICE, Jerusalem (IL); OPTIDEFENSE LTD., Kibutz Einat (IL)

(72) Inventors: Yehuda Ben Ami, Rosh Haain (IL); Amiel Ishaaya, Nes Ziona (IL); Abraham Aharoni, Rehovot (IL)

(73) Assignees: THE STATE OF ISRAEL ISRAEL NATIONAL POLICE, Jerusalem (IL); OPTIDEFENSE LTD., Kibutz Einat (IL)

( * ) Notice: Subject to any disclaimer, the term of this patent is extended or adjusted under 35 U.S.C. 154(b) by 0 days.

(21) Appl. No.: 17/257,960

(22) PCT Filed: Jul. 4, 2019

(86) PCT No.: PCT/IL2019/050744
§ 371 (c)(1),
(2) Date: Jan. 5, 2021

(87) PCT Pub. No.: WO2020/008465
PCT Pub. Date: Jan. 9, 2020

(65) Prior Publication Data

US 2021/0270576 A1 Sep. 2, 2021

(30) Foreign Application Priority Data

Jul. 5, 2018 (IL) ..... 260441

(51) Int. Cl.
*F41H 13/00* (2006.01)

(52) U.S. Cl.
CPC ..... *F41H 13/0062* (2013.01)

(58) Field of Classification Search
CPC ..... F41H 13/005; F41H 13/0062; F41H 11/02
See application file for complete search history.

(56) References Cited

U.S. PATENT DOCUMENTS 3,427,611 A * 2/1969 Enenstein ..... F41H 13/0062 398/151
5,969,851 A 10/1999 Clark et al.
(Continued)

FOREIGN PATENT DOCUMENTS

EP 2427783 1/2017
IL 225543 A 5/2018
(Continued)

OTHER PUBLICATIONS

"AN/SEQ-3 Laser Weapon System", https://en.wikipedia.org/wiki/Laser_Weapon_System, retrieved on Mar. 10, 2021.
(Continued)

*Primary Examiner* — Arman B Fallahkhair
(74) *Attorney, Agent, or Firm* — The Roy Gross Law Firm, LLC; Roy Gross

(57) ABSTRACT

A localized laser-based interceptor for kites balloons and UAVs comprises a laser and a large aperture optical beam delivery system with adjustable focal distance and spot size. The spot-size is adjusted for optimal damage performance on plastic targets, as a function of the distance from the target, its velocity across the laser beam spot and where the extent of the danger zone for personnel and equipment is limited by the fast expansion of the illuminating laser beams. The optical design ensures diverging beam to minimize the hazardous range of the system.

20 Claims, 10 Drawing Sheets

(56) References Cited

U.S. PATENT DOCUMENTS

| | | | | |
|---|---|---|---|---|
| 7,046,187 | B2 * | 5/2006 | Fullerton | F41H 11/00 342/21 |
| 7,328,644 | B2 | 2/2008 | Vickroy | |
| 7,405,834 | B1 * | 7/2008 | Marron | G01S 7/4812 356/450 |
| 8,203,109 | B2 * | 6/2012 | Taylor | G01S 7/4812 250/203.2 |
| 8,927,935 | B1 * | 1/2015 | Meline | F41H 13/0062 250/340 |
| 9,085,362 | B1 | 7/2015 | Kilian et al. | |
| 2003/0233931 | A1 * | 12/2003 | Nemtsev | F41H 13/0062 89/1.11 |

FOREIGN PATENT DOCUMENTS

| | | | |
|---|---|---|---|
| KR | 20090052415 | A1 | 5/2009 |
| KR | 101057303 | B1 | 8/2011 |
| WO | 200903884 | A1 | 3/2009 |
| WO | 2016024265 | A1 | 2/2016 |
| WO | 2007050134 | A2 | 5/2017 |

OTHER PUBLICATIONS

"Directed Energy Weapon", https://en.wikipedia.org/wiki/Directed-energy_weapon, retrieved on Mar. 10, 2021.
PCT Search Report for International Application No. PCT/IL2019/050744 dated Oct. 10, 2019, 5 pp.
PCT Written Opinion for International Application No. PCT/IL2019/050744 dated Oct. 10, 2019, 6 pp.
PCT Preliminary Report on Patentability for International Application No. PCT/IL2019/050744 dated Jan. 5, 2021, 7 pp.

* cited by examiner

LASER INTERCEPTOR FOR LOW-FLYING AIRBORNE DEVICES

This application is a National Phase of PCT Patent Application No. PCT/IL2019/050744 having International filing date of Jul. 4, 2019, which claims the benefit of priority of Israel Patent Application No. 260441, filed Jul. 5, 2018, the contents of which are all incorporated herein by reference in their entirety.

FIELD OF THE INVENTION

The present invention relates to methods and systems for the interception of low flying soft airborne devices, and, more particularly to methods and systems for interception of incendiary kites and balloons, drones and other unmanned aerial vehicles (UAVs).

BACKGROUND OF THE INVENTION

U.S. Pat. No. 7,328,644 discloses a system has a containment blanket. The system further has a launcher configured to launch the containment blanket and logic configured to deploy the containment blanket. The containment blanket is configured to encompass an incoming projectile.

U.S. Pat. No. 9,085,362 discloses a deployable net capture apparatus which is mounted on an unmanned aerial vehicle to enable the interception and entanglement of a threat unmanned aerial vehicle. The deployable net capture apparatus includes a deployable net having a cross-sectional area sized for intercepting and entangling the threat unmanned aerial vehicle, and a deployment mechanism capable of being mounted to the unmanned aerial vehicle. The deployment mechanism includes an inflatable frame or a rod for positioning the net in a deployed position.

The abovementioned counter-measure drones have achieved some success in intercepting incendiary kites and balloons, drones and other UAVs but they demonstrated lack of effect in the case of a massed attack. Thus, there is a long-felt and unmet need to provide a system capable to stand against massed attacks of low-flying objects such as incendiary kites or balloons, drones and other UAVs.

SUMMARY

It is hence one object of the invention to disclose a localized laser-based interceptor for kites balloons and UAVs comprising: (a) a MWIR or LWIR laser; and (b) a large aperture optical beam delivery system with adjustable focal distance and spot size.

It is a core purpose of the invention to provide the spot-size adjusted for optimal damage performance on plastic targets, as a function of the distance from the target, its velocity across the laser beam spot and where the extent of the danger zone for personnel and equipment is limited by the fast expansion of the illuminating laser beams.

Another object of the invention is to disclose a localized laser-based interceptor for kites balloons and UAVs comprising: (a) two MWIR or LWIR lasers aligned to generate cross polarization; and two large aperture optical beam delivery systems with adjustable focal distance, spot and angular offset control of the output beams.

Another object of the invention is to disclose a laser system for intercepting a low-flying object. The aforesaid system comprises: (a) at least one laser arrangement providing a convergent laser beam; each said laser arrangement comprising: (i) a laser generating a laser beam; (ii) a large aperture optical beam delivery system configured for converting said laser beam into an adjustable beam converging to a minimal spot on said low-flying object and further propagating in a divergent safe manner; (b) a target designating unit configured for determining a distance, velocity and a direction to said low-flying object.

It is another core purpose of the invention to provide a large aperture optical beam delivery system is further configured for receiving said distance, velocity and direction to said low-flying object and adjusting convergence of said laser beam according to said distance, velocity and direction received from said target designating unit such that a laser spot of minimal size is formed on said low-flying object.

A further object of the invention is to disclose the laser system comprising a platform provided with leveling jacks configured for levelling and stabilizing said platform.

A further object of the invention is to disclose the platform which is mounted on a self-propelled vehicle.

A further object of the invention is to disclose the at least one laser which is a mid-wave or long-wave infrared laser.

A further object of the invention is to disclose the laser system comprising at least two said laser arrangements providing two convergent laser beams crossed to each other such minimal spots thereof are overlapped on said low-flying object.

A further object of the invention is to disclose the target designating unit comprising at least one aiming camera.

A further object of the invention is to disclose the target designating unit comprising two aiming camera cooperatively determining said direction to said low-flying object.

A further object of the invention is to disclose the target designating unit comprising at least one camera configured for recognizing said low-flying object.

A further object of the invention is to disclose the target designating unit comprising at least one night-vision camera.

It is an object of the present invention to provide a laser-beam capable of intercepting and neutralizing kites and balloons such as those deployed in low intensity conflicts. For this purpose a laser operating at a wavelength at which the plastic components of such kites and balloons absorb the light. Such wavelengths differ significantly from the standard laser weapon systems that operate at 1 μm where the said materials are almost entirely transparent. Using longer wavelengths ensures higher absorption of the light by these materials, allowing thermal induced damage, such as perforations and cuts in the material, compromising their ability to remain airborne and thereby neutralizing them.

It is a further objective of the present invention to deploy the same laser system to neutralize drones and UAVs. These, typically, incorporate many plastic components, including their bodies and rotors; we have demonstrated that the proposed laser beam can burn holes through the plastic and incapacitate the UAV. Notwithstanding the above, the proposed longer operating wavelengths are not less efficient in damaging composites and metal than the more standard illumination at 1 μm.

A further object of the present invention it to generate sharply focusing laser beams for the purpose above such that beyond its focal region the beam spreads relatively quickly. The combination of the rapid beam-spread, which reduces its power density, with the use of longer wavelengths ensures that the safety distance for personnel and equipment along the beam propagation direction is relatively short. In this manner the deployment of the present invention is localized, allowing its application close to non participating civilians, and the free operation of neighboring personnel and equipment, including reconnaissance UAVs and manned aircraft.

Yet another objective of the present invention is to optimize the illuminating laser spot on the target. As we demonstrate in the following, the smallest achievable spot size on the target is not necessarily the most effective in generating the required heating. The targets here move in irregular directions and varying speeds; in such situations a very small spot size does moves over the surface of the target, failing to remain at any specific point sufficiently long to reach the damage threshold. The spot size on the target is adjusted for the optimal dimensions as a function of the target distance, its relative speed across the illumination spot, and, to the extent known, to its material composition. For this purpose the distance to the target is measured, and the target behavior is tracked to determine the optimal beam spot.

The invention anticipates an infra-red (MWIR) or long wave infra-red (LWIR) laser with a large optical delivery aperture that can focus down to an effective spot at a relatively short distance for localized operation against soft airborne devices. The geometry of the beam, to be deployed at relatively short range, say 1 Km, ensures that behind the focal plane the beam expands quickly and does not pose a safety hazard at large distances: for direct exposure to personnel this can be a range on the order of 1.5 to 2 Km. For unmanned drones and aircraft this is several hundred meters where the power density, even on a stationary platform are far below the potential damage level. This applies to the surface of the various materials, as well as the cockpit windows regardless of their material, glass or polycarbonate.

An alternative implementation anticipates the use of two or more MWIR or LWIR lasers, each with a large optical delivery aperture that focuses to an effective spot at a relatively short distance for localized operation against soft airborne devices. The spots of all the lasers are adjusted to overlap at the target, each expanding after the focal point to reduce the power density of each beam, and their limited overlap, the power density of the entire beam delivery to safe levels in relatively short distances behind the focal plane.

The system can optionally be operated from a remote operator's station. Apart for offering convenience and safety in border violence scenarios this operation method affords for the operation of multiple systems by one operator's team.

The system is also designed to allow piecewise limitation of effective range that can defined for each azimuth and elevation segment. This allows for design of a specific tailored hazard footprint for operation in urban settings.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
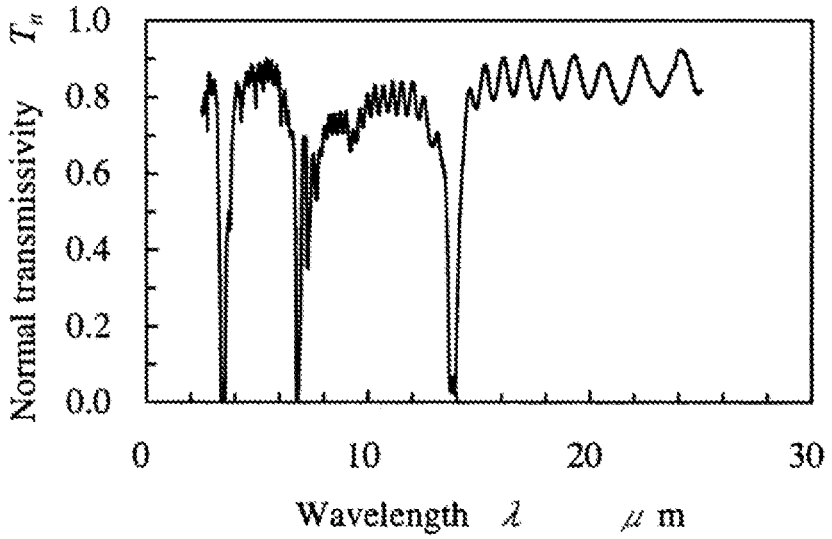
FIGS. 1*a* and 1*b* show the absorption of 0.1 mm thick polyethelyne and the absorption of the atmosphere, respectively, at MWIR and LWIR spectra.

In the following description of some embodiments, identical components that appear in more than one figure or that share similar functionality will be referenced by identical reference symbols.

The current invention proposes a laser-based countermeasure that is specifically designed to damage the light materials deployed in the kites and balloons, namely various plastics such as polyethylene, nylon, latex and similar materials. While laser weapons have been demonstrated and even deployed in the field (see for example https://en.wikipedia.org/wiki/Laser_Weapon_System and https://en.wikipedia.org/wiki/Directed-energy_weapon) such weapons would typically be unsuitable for the current application for the following reasons:

a) The materials indicated above are mostly transparent at the wavelengths used in such weapons, typically near 1 μm. The availability of very high power lasers in this wavelength make them a natural selection. But for weapons with multi-KW to 100 KW, only a small fraction of the power reaching a transparent target is effective in heating it, making the use of lasers at this wavelength highly inefficient if not completely ineffective.

b) The second property of the lasers at 1 μm, their ability to focus to small spots, while an advantage in their general application as weapons, prove to be a drawback when attempting to damage transparent plastic sheets. As explained below, we have predicted and demonstrated there is an optimal spot size for damaging a transparent sheet in irregular motion such as experienced with a kite in free flight. As the spot size increases the energy density on the target drops and the required exposure time increases. Nevertheless, if the heating spot size it too small, its irregular motion across the target disrupts the heat delivery to a specific location on the target and allows it to cool off, preventing the required damage.

c) The high focusing ability of conventional laser weapon and their high-power ensure large effective ranges. While this is certainly an advantage for conventional application, allowing their application against distant targets, their large range is in fact a drawback in the asymmetric conflict where civilians are present: very large safety distances are required, severely limiting their deployment. The safety of civilians in the arena, and that of friendly personnel and equipment in the vicinity, for example reconnaissance drones which are necessary to track the launching of such soft airborne devices, might be compromised by the deployment of high-power lasers at 1 μm, which remain lethal at very large distances.

It is the purpose of the present invention to favorably address these three aspects: a relatively efficient engagement of materials that are transparent in the visible and near infra-red (NIR) spectra; provide for an optimal spot-size on the surface of the target in view of its irregular motion to achieve optimal damage infliction; and limit the extent of the danger zones during the deployment of the proposed laser interceptor to the vicinity of the targets, allowing personnel and equipment to be present relatively close to the targets being engaged. With conventional laser weapons the safety distance extends over several kilometers; with the proposed arrangement this safety distance can reduced to less than a kilometer. Moreover, the design of the proposed system allows for piecewise tailoring the range and angular extents of the hazardous regions to accommodate specific location that requires protection.

Figure 1B:
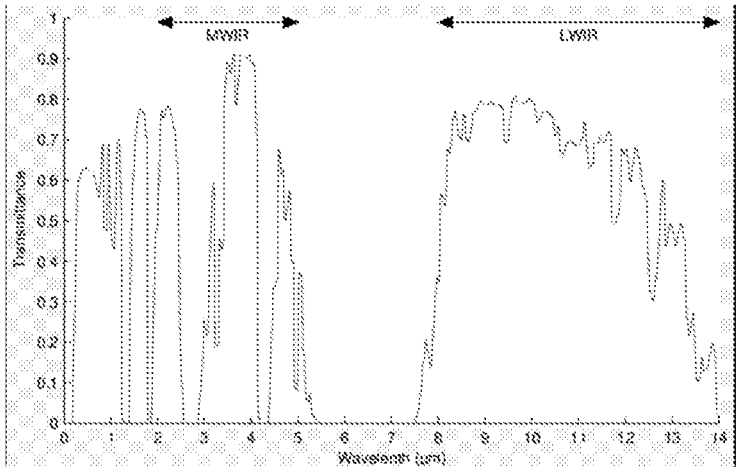

One aspect of the current invention relates to the operating wavelength of the laser. Targeting plastic materials, the state-of-the-art laser weapons operating at around 1 μm are unsuitable as the plastic materials used for kites and balloons are essentially transparent at these wavelengths. Therefore deploying lasers at these wavelengths requires extremely high power levels to reach the damage threshold, making the process energetically in-efficient, raising the cost of the system, and as already indicated in the introduction, significantly enlarging the required safety distance in the direction of illumination. FIG. 1*a* shows the transmittance of a 0.1 mm thick polyethylene sheet as a function of wavelength at mid wave infra-red (MWIR) and long wave infra-red (LWIR) spectra. This data is representative for most other plastic materials such as latex or nylon and also for various rubbers. Apart for the discrete absorption lines (for polyethylene at around 3.6, 6.8 and 12 μm) most of the spectrum shows absorption on the order of 10-20% (transmissivity of 90-80%, respectively). Selection of an operating wavelength for this application should generally avoid selection of discrete high absorption lines, which are necessarily material specific, and consider the transmission windows through the atmosphere (FIG. 1*b*) to minimize power loss due to propagation in the atmosphere. While other laser systems exist at the suitable wavelength ranges, we have chosen to demonstrate the proposed invention with a $CO_2$ laser at 10.6 μm, mainly for its abundance in industry, its high reliability and potential for delivering high power (several KW) with high quality beams. Future application may consider other laser systems including a Thulium laser (at around 2 μm) which may prove convenient in its form as a fiber laser; or the chemical deuterium fluoride laser (at 3.8 μm). As indicated in the introduction, the application of the 10.6 μm laser offers significant advantages in this application, not only due to its larger absorption in the target than conventional laser weapons at 1 μm, but also in a significantly reduced safety distance in the illumination direction. With regards to manned aircraft, the 10.6 μm does not penetrate glass or polycarbonate cockpits. As for unmanned UAV's once the beam is defocused, the power density falls rapidly below the damage threshold. As for personnel in the line of illumination, the safety distances for 10.6 μm are also significantly reduced as compared to 1 μm light. The safety thresholds for the latter are several orders of magnitude more challenging as compared to those in the MWIR and LWIR.

Having considered the higher efficiency of LWIR for plastics, we note that for metals and composites the power density damage threshold of LWIR is somewhat higher than for 1 μm radiation, it is still possible to damage these materials at LWIR. In industry LWIR lasers are used for cutting and welding metals, so with sufficient power density it is possible to neutralize also UAV's constructed from metal and composites.

Figure 2A:
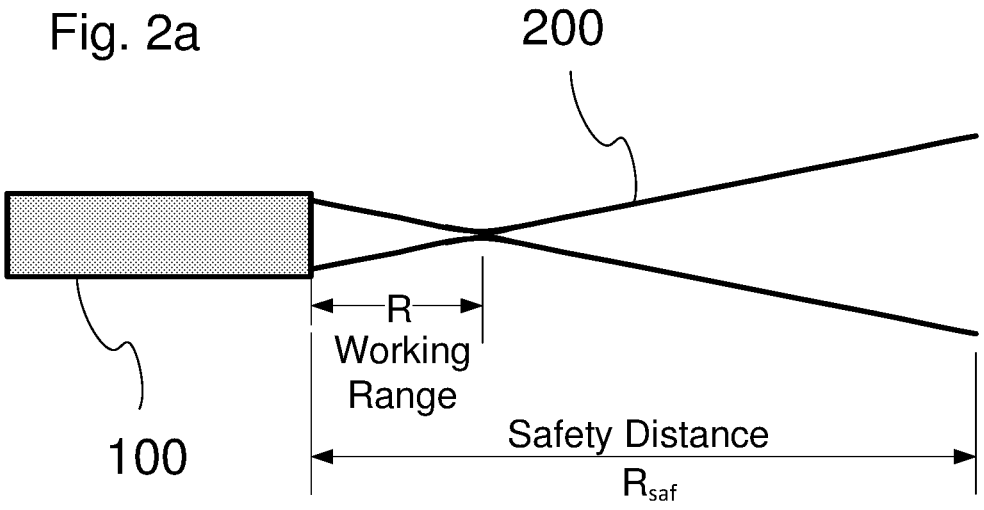
FIG. 2*a* schematically shows the advantage of using a sharply focusing laser beam according to the current invention whereby the laser beam spreads relatively quickly reducing the required safety distance along the beam illumination direction.
Figure 2B:
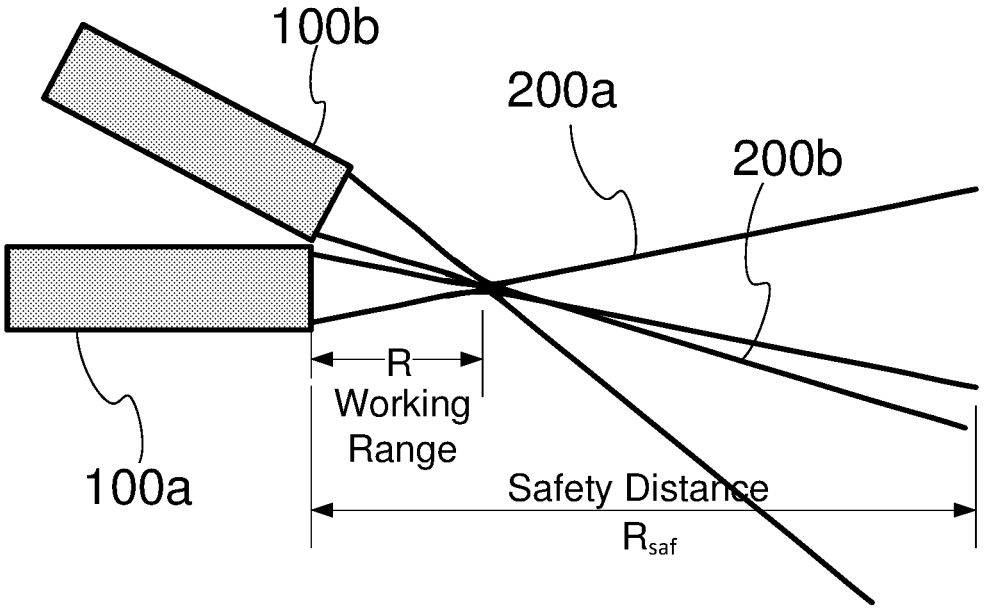
FIG. 2*b* schematically shows the advantage of using two lasers with offset beams with their spots overlapping on the target according an aspect of the current invention ensuring fast rapid of the power density after the target to reduce the required safety distance along the beam illumination direction.

A reduced safety distance in the illumination direction, is an important objective of the current invention. This is achieved, in addition to the use of LWIR with its higher safety thresholds, also by the incorporation of relatively large optical apertures and a relatively sharp focus down to the target (FIG. 2*a*) ensuring a relatively rapid defocusing behind the operating distance R, ensuring a reduced power density at relatively short distances, allowing the presence of personnel and equipment at closer range than would be possible otherwise. Additionally or alternatively the sharp focusing can be implemented with two or more laser units slightly offset relative to each other but all focusing to the same target location; the power of the multiple laser sources is designed to superimpose on the target, but as each beam diverges off at a different angle after the target, the safety distance can be maintained small. Coherent interference between two such laser beams can be avoided by use of orthogonal polarizations in the two beams. If more than two beams are added, some interference may occur, although the angular spread between the beams will ensure that the resulting interference pattern will exhibit a relatively dense fringe pattern with negligible effect on the heating performance of the combined beam spot. A representative two-beam superposition arrangement is shown schematically in FIG. 2*b* where two beam delivery systems 100*a* and 100*b*, generate two beams, 200*a* and 200*b*, that overlap at their foci on the target but diverge rapidly away from each other thereafter. We note that, in practice, the beam delivery systems themselves of such an arrangement would be mounted parallel to each other, only their main mirrors tilted to convergence the two beams towards the common focal point. Naturally, the convergence angle here varies with the range of the target; the adjustment of such a convergence angle is most conveniently adjusted by tilting the main mirror, as discussed in the following.

Figure 3A:
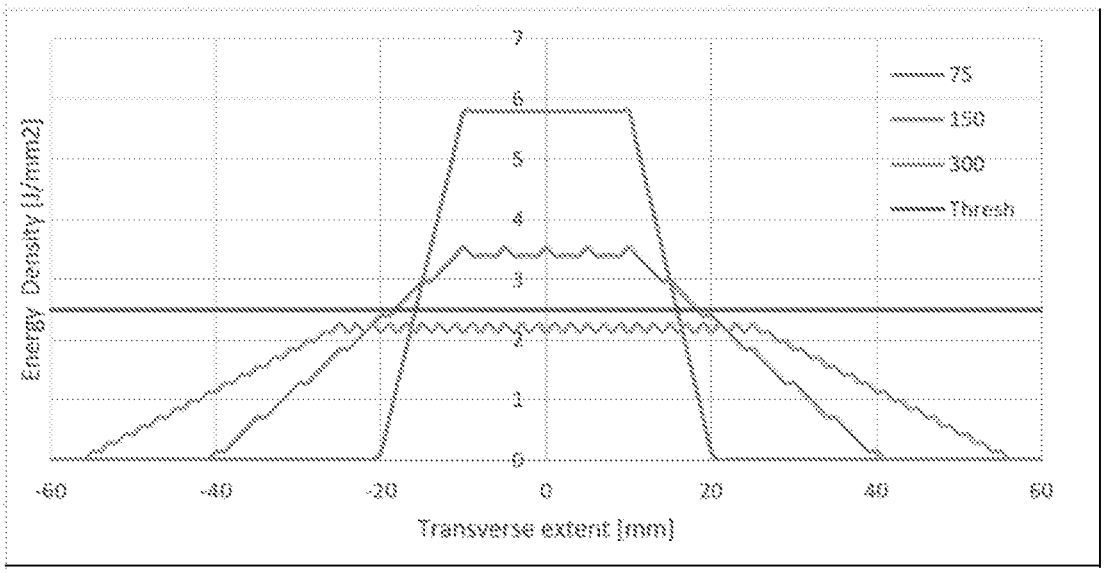
FIG. 3*a* presents the results of a simple model for heating a thin plastic sheet with a 400 W laser focused to a spot of 30 mm diameter at different relative velocities of the beam over the plastic sheet (75, 150 and 300 mm/s). The red line indicates the required damage threshold.
Figure 3B:
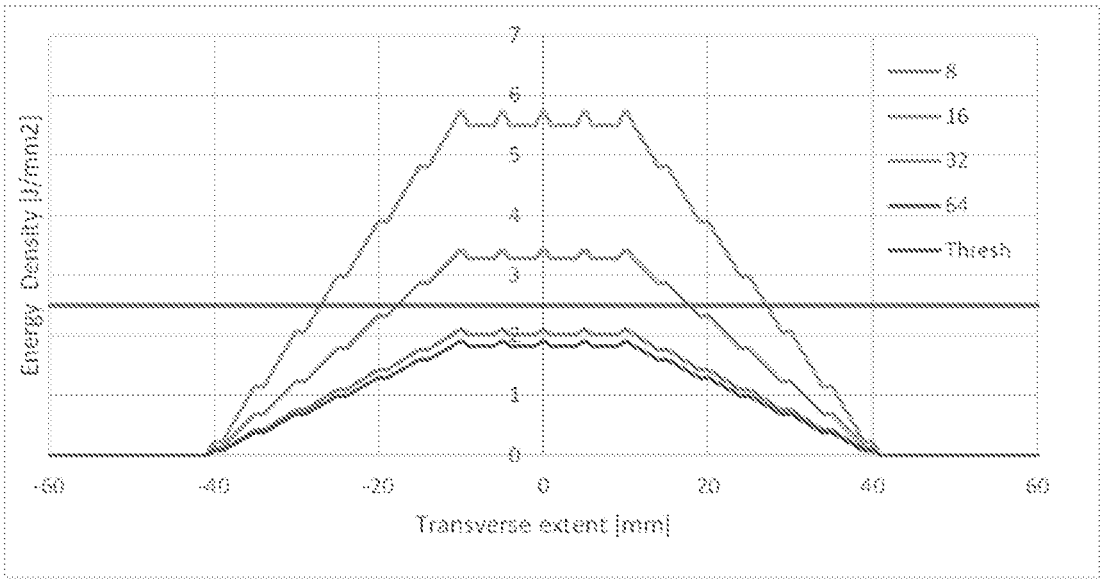
FIG. 3*b* presents the results of a simple model for heating a thin plastic sheet with a relative velocity of the beam over the plastic sheet at 200 mm/sec for different beam spot diameters (8, 16, 32 and 64 mm). The red line indicates the required damage threshold.

FIG. 3*a* plots the results of simplified model for the expected total heat delivery to a given length of a thin target sheet. The values are calculated for a 400 W laser with a 1 s pulse and a 30 mm diameter spot on the target for different relative velocities of the spot over the target. As might be expected, as the relative velocity of the spot across the target increases from 75 mm/s (blue graph) to 150 mm/s (orange graph) to 300 mm/s (gray graph) the deposited energy density is reduced, finally falling, for the 300 mm/s to below the damage threshold (indicated by the red line). These results are commensurate with preliminary measurements in the field. In practice, the objective is to ensure that the laser illumination reaches the damage threshold. This can be accomplished either by reducing the relative velocity between the target and the illuminating spot, by accurate tracking of the target, or by increasing the energy deposited on the target by increasing the available laser power, or incorporating both measures. Interestingly, the reduction of the illuminating spot size does not necessarily increase the energy density on the target. As shown in FIG. 3*b*, a simulation for different spot sizes moving across the target at 200 mm/s. The threshold energy density is not reached both when the spot size is too large (64 mm dia—blue graph) or too small (8 mm dia—light blue graph above the blue graph). This is caused by the increased cooling rate of small heated regions on the target. It is therefore necessary to seek an optimal spot size-on the target. The ability to control the spot-size on the target, and to set it to an optimal size, is an important attribute of the current invention, for which the optical delivery system is designed to allow such adjustments.

Figure 4:
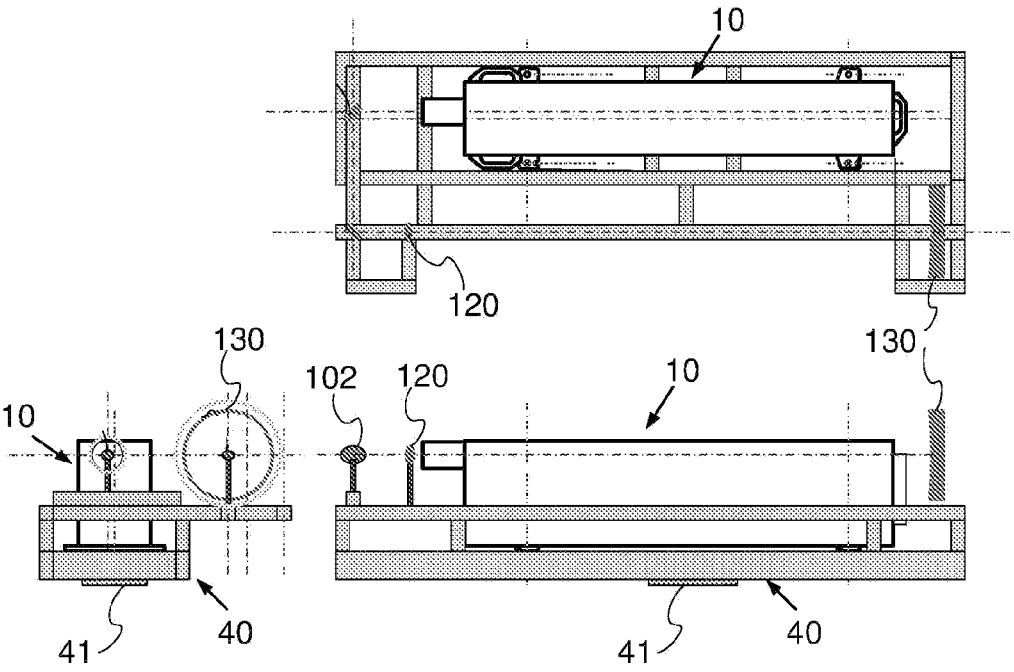
FIG. 4 schematically shows three views (front view on the left, elevation view at the bottom right and plan view at the top right) of a conceptual construction of a laser-based interceptor for soft airborne devices according to an embodiment of the current invention.

FIG. 4 schematically depicts the main components of a laser-based interceptor for soft airborne devices. A MWIR or LWIR laser 10 delivers a high quality beam to a set of beam redirecting mirrors, represented schematically by mirrors 101, 102. For example, a $CO_2$ laser is conveniently used for this purpose. The laser beam is then expanded with lens 120 to fill the main reflecting parabolic mirror 130. The main mirror redirects a nearly collimated beam to the output. In this implementation the lens and last folding mirror 102 obstruct the output beam; the tradeoff here is a few percent loss in delivered laser power to simplicity and robustness of the optical design. An alternative design uses a Cassegrain arrangement, where the folding optics couples the input beam through a small opening in the main mirror to an on-axis hyperbolic secondary mirror. The Cassegrain arrangement also suffers some masking of the output beam for losses of a few percent in delivered power. Yet another alternative is an off-axis enlarging mirror feed, that is positioned outside the output beam and ensures no masking of the output beam. This design, however, suffers increased aberrations on the target. The selection of the appropriate optical configuration requires considerations of the various tradeoffs. In any case two features for the optical delivery system must be maintained: (a) motorized control of the spot-size on the target; and (b) motorized control of the angular offset of the main mirror in its two orthogonal angular axes. In the first implementation with the expanding lens, the spot-size on the target can be adjusted by controlling the distance of the expanding mirror from the main mirror. This adjustment effectively moves the waist of the output Gaussian beam from infinity (where the output beam is essentially collimated) to a nearer location where the output beam is essentially focused at a short distance, for example at 100 m. Such short focus facilitates pre-operation testing and boresight calibration.

The angular offset of the main mirror provides for fine adjustment of the output beam's direction. This is implemented with two motorized axes and can be used for fine tracking of the target's motion, or, if required for specific targets, dithering of the location of the spot on the target. This mechanism also serves for converging two or more laser optical systems for increased overall power, as described above.

A further optical adjustment, preferably automated, introduces ellipticity into the output beam. This can be achieved adding some one dimensional optical power to one of the folding mirror. Such an elongated beam shape may offer an advantage when negotiating an elongated portion of the target, for example the string attaching the payloads to the kites or balloons, or the strings of the kite tails, or the strings used to launch the kites or balloons.

In addition to the main optical delivery system there is an alignment beam injected into the main beams' optical path (not shown in FIG. 4). In the case of the lens implementation describe above this is a red laser alignment beam that is injected into the optical path with a small-angle GaAs beam splitter. The red laser is transmitted through the lens, typically made of ZnSe. In the other two configurations any visible range wavelength can be used, where, typically a green laser would be preferred for the high power readily available in this wavelength, for example with a doubled NdYAG laser. The introduction of the co-axial visible light beam facilitates the alignment of the optical components in the optical delivery system and allows for fast visual confirmation in the field that that the system is correctly aligned. Additionally and optionally a powerful co-axial visible laser illumination can facilitate the bore-sight calibration with aiming devices (for example the aiming camera) as well as provide a visual aiming reference for pointing the laser at the target whether such pointing is performed manually by eye, manually through identification of the visual aiming spot on the aiming camera, or serve as a convenient reference to the aim of the system in automated target tracking algorithms. Alternatively and optionally a powerful laser beam can be incorporated in parallel to the main laser beam for the same purpose.

A power meter is included in the optical system to allow monitoring of the laser's output power in setup testing and alignment operations, in pre-operation calibration testing, as well as an in-use as a verifier for the performance of the laser. This meter (not shown in FIG. 4) is readily aligned to receive the small reflection off the GaAs beam splitter if one is employed to couple in a red co-axial alignment beam, or aligned to an alternative low power reflection of the main laser beam within the optical delivery system.

The laser 10 and optical delivery system 100 are mounted on a high rigidity, low thermal expansion chassis 40, the entire assembly is enclosed in a protective cover (not shown in FIG. 4) which also serves as a safety baffle for the operators as well as to prevent contamination of the laser and optics from the environment (such as dust particles and rain). The front of the optical delivery system includes a protective cover that is removed just before activation. Alternatively and optionally a transparent fixed window can be used. The enclosure also includes service hatches to check and service the various optical components of the system.

The entire laser assembly of FIG. 4 is mounted on an elevation over azimuth pedestal (FIG. 4 shows the pedestal's mounting plate 41).

Figure 5:
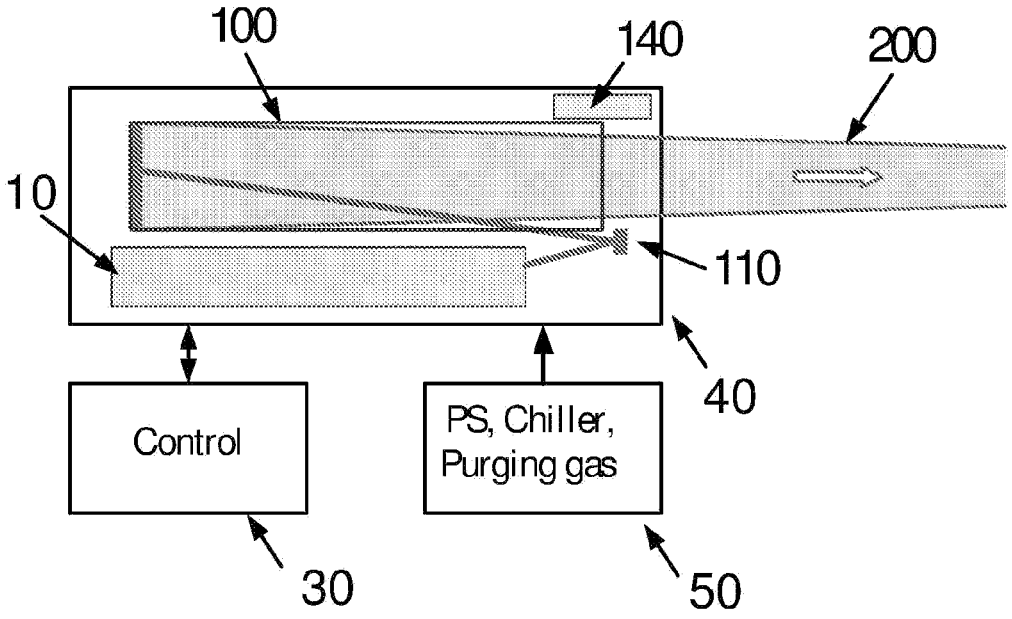
FIG. 5 schematically shows the main components of a laser-based interceptor for soft and other low-flying airborne devices according to an embodiment of the current invention.

FIG. 5 shows additional modules incorporated in the system, namely an aiming camera 140, a range finder (not indicated in FIG. 5), support modules 50 including a power supply (PS), a closed water chiller, and a filtered air purging system which serves to continuously purge the high-power optics to ensure no dust settles on them. The system also includes a control station 30 displaying the status of the system (monitors of PS and cooling water temperature, output power of the laser, purging gas supply pressure and other indications) is displayed, the aiming camera's image, the coordinates of the pedestal are controlled, as well as the range-finder's readings. The camera 140 provides for remote control zoom to identify the target at varying fields-of-view. In this arrangement the entire assembly is mounted on an elevation-over-azimuth pedestal to point the laser in any desirable angular direction; The support modules 50 and the control station 30 remain stationary.

Figure 6:
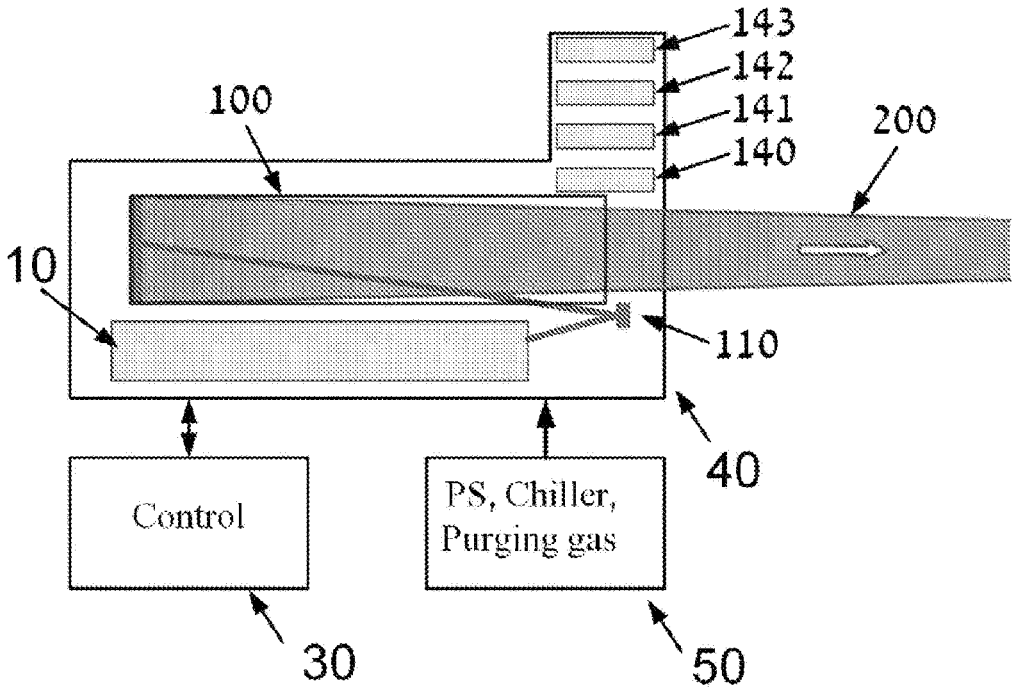
FIG. 6 schematically shows the main components of a laser-based interceptor for soft and other low-flying airborne devices according to yet another embodiment of the current invention.

FIG. 6 depicts additional cameras that may be mounted onto the system for improving its performance and operation. These are marked schematically as 140-141, 142 and 143 in the figure. Additionally and optionally a second aiming camera (141) is incorporated into the system at an appreciable separation (baseline) to allow detection of the target distance by triangulation as backup to the optical rangefinders which may not perform well against small transparent targets. Typical baseline values are 500, 800 or 1,000 mm separation between the cameras.

Additionally and optionally a night-vision camera is mounted onto the system for aiming operations at night (142). Use of a thermal sensitive camera can also benefit from the ability of the camera to identify the laser illumination spot on the target. Such capability is invaluable for pre-operation alignment operations, for identifying targets which have a different thermal signature than the surroundings, to verify that the laser spot is located on a target and to assist with automated locking of the laser onto the target.

An additional camera 143 can be deployed for identifying potential targets. In its preferred mode of operation the interceptor receives information as to the location of potential targets from external systems. These can be radar system, electronic triangulation systems that can locate a communicating target in three-coordinates, electronic interception of location data off the target itself or optical means identifying the target and providing location data. Notwithstanding the above, it is to the benefit of the system to be capable of identifying targets independently. For this purpose a wide-field-of view camera can be used with dedicated software that can identify targets and discriminate them from the background and other interfering objects, such a birds. A deep-leaning algorithm is configured for identifying potential targets at suitable distances and allows the system of the present invention to direct the aiming camera characterized by the narrow field-of-view onto the target for final confirmation, tracking and interception.

Figure 7:
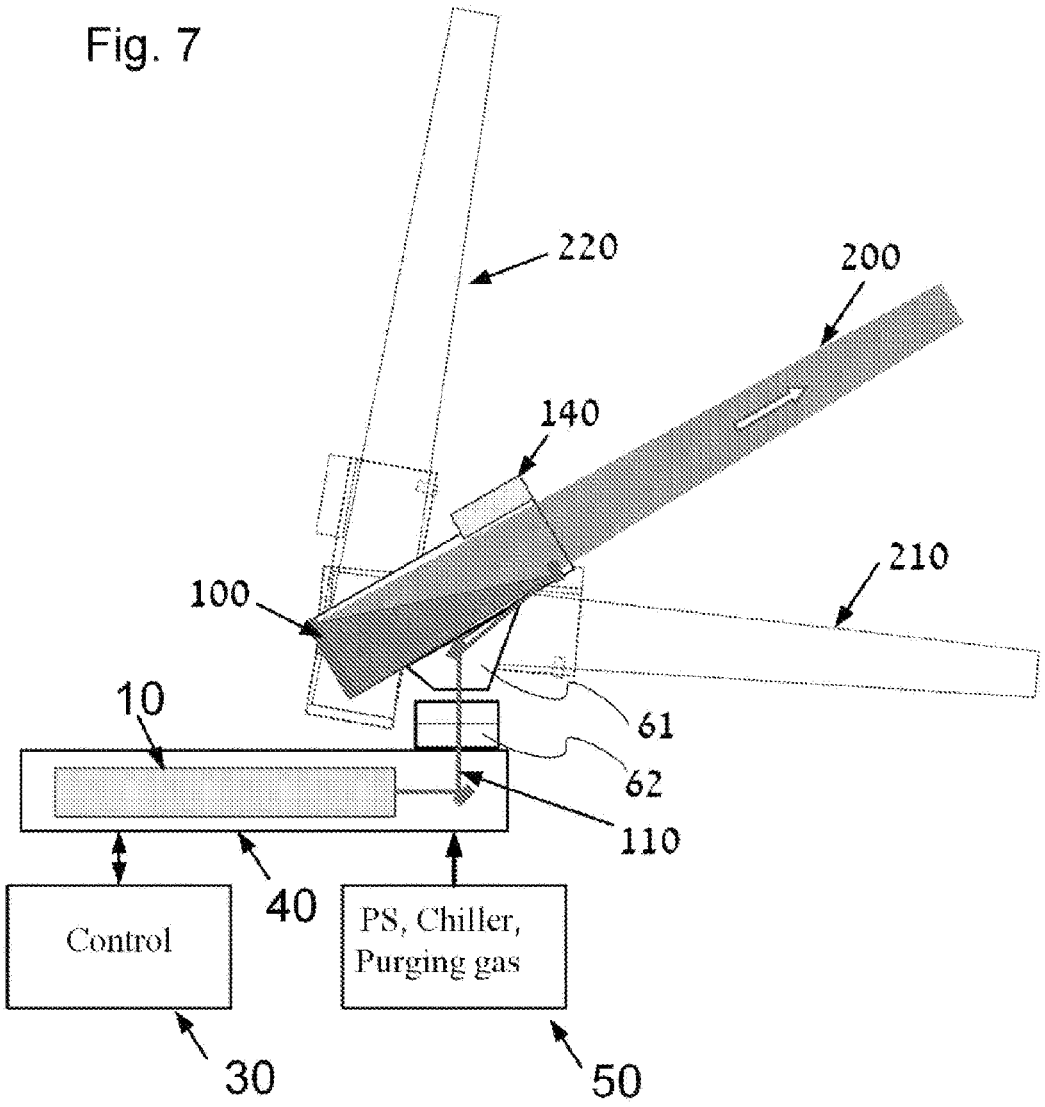
FIG. 7 schematically shows the main components of a laser-based interceptor for soft and other low-flying airborne devices according to another embodiment of the current invention.

FIG. 7 shows an alternative configuration where only the optical delivery system 200 is manipulated in two angles to cover the entire elevation range from 210 to 220, and the full azimuth rotation range. The elevation 61 and azimuth axis 63 move only the optical delivery system and any beam aiming devices mounted on the same assembly (including the aiming camera 140, an optional target illumination laser whether co-aligned or parallel to the main beam, a range finder and optional second aiming camera for backup target distance measurement by triangulation and thermal cameras for identification of the illumination spot on the target). This allows for a much lighter payload for direction towards the target with the associated improved performance. Such an arrangement requires a more elaborate beam folding and redirecting arrangement 110, such that the beam enters the azimuth axis along its axis and is not affected by the azimuth position variation and an elevation folding mirror that compensates for the required delivery angle into the optical system as the elevation axis moves. Here the laser itself 10 is stationary as are the support modules 50 and the control station 30.

A third alternative deploys a flat re-directional mirror at the output of the optical delivery system. This re-directional mirror moves in both the azimuth and elevation axes and allows the rest of the system to remain stationary.

Figure 8:
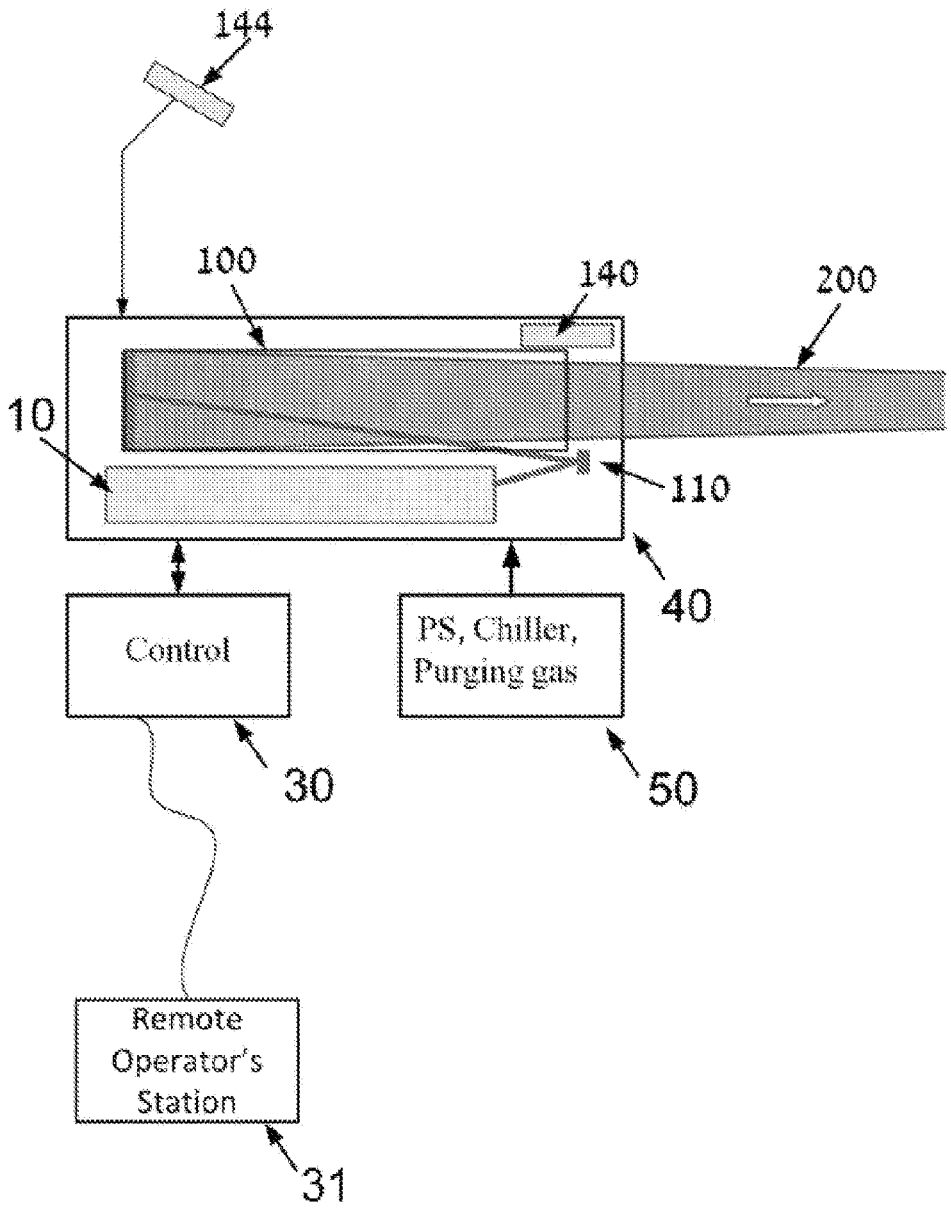
FIG. 8 schematically shows the main components of a laser-based interceptor for soft and other low-flying airborne devices according to a fourth embodiment of the current invention.

FIG. 8 schematically depicts an alternative configuration where the operation of the laser interceptor is controlled by a remote operator's station 31. This arrangement has the advantage that the operators can be located at a safe distance from the interceptor when operating in border protection missions against hostile activities in which the interceptor itself may be targeted. Such operation may also be more convenient to the operators who may enjoy a location with vantage view of the area of operation and a controlled environment. Such remote location would typically benefit from additional security camera or cameras 144 located to view the laser-interceptor itself and its locations. Alternatively and additionally, cameras can also be located on a distant calibration target that can assist "hot calibration" verification of the laser interceptor by firing onto such a target using a camera feedback to identify the location of a hit. A major advantage of the remote operation arrangement is the potential for several laser interceptors to be operated by the same operator's team. In many scenarios, including border protection, and large airport grounds, the operation of several laser interceptors is required. Remote operation of several such interceptors in close vicinity is a convenient and efficient implementation.

Figure 9A:
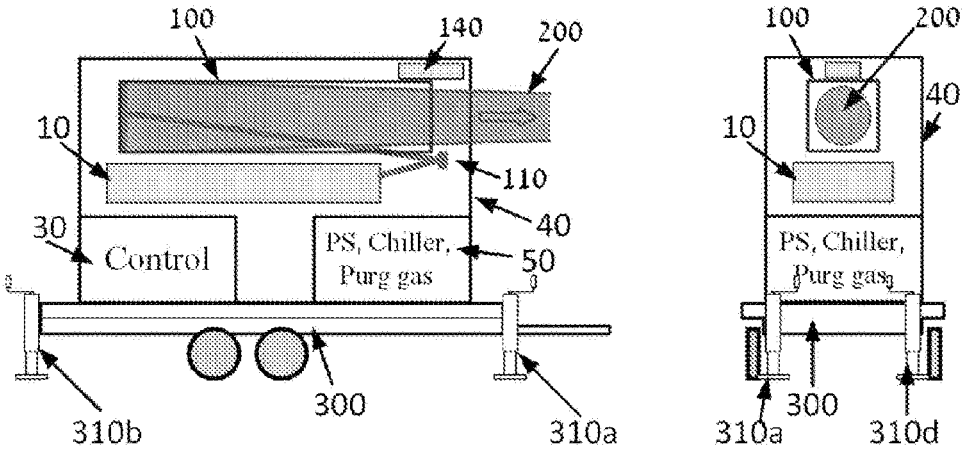
FIGS. 9*a* and 9*b* schematically show options for platforms for implementing a laser-based interceptor for soft and other low-flying airborne devices according to embodiments of the current invention.

FIG. 9*a* shows schematically the mounting of the laser interceptor on a mobile platform in two perspective views: a side view and a front view. The figure depicts a trailer that can be towed by a road vehicle. Such a trailer includes several, for example, four leveling jacks (310*a* through 310*d*, 310*c* is hidden in both perspective images). Once in position the leveling jacks are used to level and stabilize the platform to ensure smooth and optimal motion of the pedestal. The trailer includes a set of springs and shock absorbers to minimize the shock and vibrations experienced by the system in transit. When the platform is made ready for motion the jacks are retracted and locked at a large distance from the ground. Similarly the interceptor can be mounted on other land-mobile platforms, such as pickup trucks, or rough terrain vehicles. A distinction must be made between platforms that are used for transportation only and those from which the interceptor can be deployed in motion. The latter category requires that the pedestal be powerful enough to accommodate the accelerations and load encountered by the system due to its motion. Once such capability is available the interceptor can also be mounted on shipboard for operation at sea, potentially to protect various sea-side and off-shore strategic facilities.

Figure 9B:
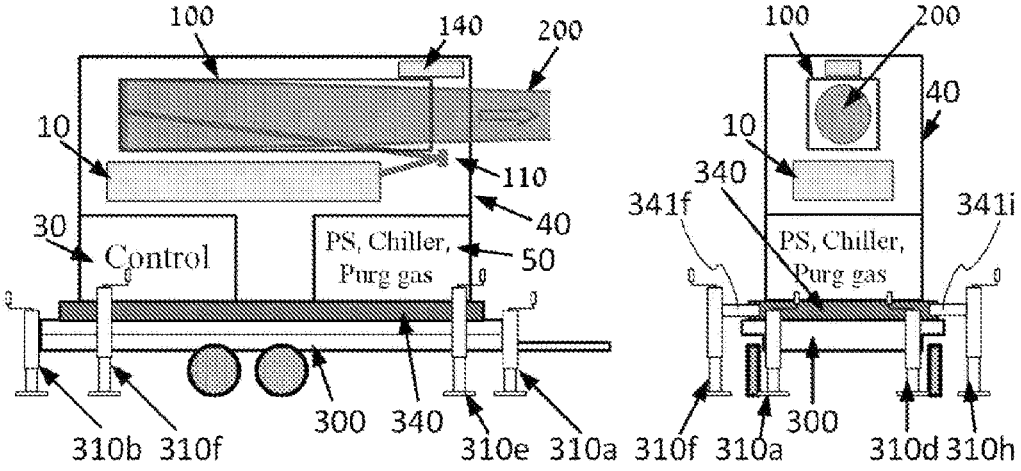

FIG. 9*b* shows schematically the mounting of the laser interceptor on a mobile platform with the used of an independent sub-chassis in two perspective views: a side view and a front view. The sub chassis offers greater flexibility in mounting the interceptor onto a variety of platforms. Incorporating a set of independent jacks, for example four units (310*e* through 310*h*, 310*g* is hidden in both perspective images), it can be disconnected from a mobile platform, raised sufficiently to allow removal of the mobile platform from under it and allow the insertion of a different mobile platform in its place. This allows for operation of the laser interceptor mounted on the sub-chassis alone; mounting the sub-chassis onto a variety of suitable platforms and re-mounting it onto other platform without the need to rely on external lifting devices. To allow the insertion and removal of mobile platforms from under the chassis, each of its jacks include a shifter beam 341*e* through 341*h* that allows the spread between jack to be enlarged beyond the width of the platform onto which it is mounted. Once mounted on the designated platform the jacks can be either removed or retracted and locked a at a distance from the ground.

The laser-based interceptor may be operated in different modes:

a) Manual, where the operator points the system in a specific direction, either by moving a pointing device on the screen of the control station, or entering specific axes coordinates. The operator may also continue to move the system manually to track a target that is visible in the image of the aiming night and/or daylight cameras.

b) External coordinate direction; for distant targets it may be difficult for the system operator to locate and identify targets directly. In such cases the system may receive the target coordinates in space (x,y,z) from a separate target locator, whether manned or unmanned. The system, which is setup aligned to the absolute map grid, can then translate the absolute coordinates of the target to coordinates relative to its location, namely azimuth, elevation and range, and direct the system to point in the direction of the target. Once pointing in the direction of the target, the target should be identifiable on the night, and/or thermal and/or daylight aiming cameras. Once acquired by the aiming cameras of the system, can revert to one of the monitoring/tracking operation modes. The external coordinates can alternatively be provided in terms of azimuth, elevation and range from another known location (for example the location of a radar station), or, preferably in azimuth, elevation and range from the location of the laser-based interceptor after the coordinated obtained in an external position have been translated to the location of the interceptor.

c) Automated target acquisition/classification. Software routines for target acquisition and classification are included with the system. The target acquisition routine identifies a specified target, whether manually or by direct coordinate feed from an external target locating system. The target identification software then locks onto the image of the target and can be used to track it (see below). Another algorithm is applied to the image of the target, attempting to classify it; the classification, whether a kite, balloon or UAV permits specialized tracking algorithms for each target type with optimized tracking parameters for each target type.

d) Automated target tracking, using the target acquisition routine to continuously identify its position and redirect the laser to track it. Two different tracking routines are available; tracking the image of the target using the day and or night and or thermal camera display, or identifying the laser illumination directly (with the thermal camera) or its co-axis alignment illumination spot (with day or night cameras) on the target as identified on the day aiming camera. The main advantage of the automated tracking is to allow extended exposure on a relatively small area within the target for increasing the energy delivery to damage the target. It also allows for reduced relative speed between the illuminating spot and the target, similarly increasing the energy delivery capability of the system.

e) Monitoring the laser MWIR/LWIR beam spot on the target using the optional thermal camera image. Such monitoring provides for confirmation for the correct operation of the laser in terms of power, and of the other system components in terms of the correct alignment of the illumination spot on the target.

f) Automated battle-damage-assessment (BDA), through identification of the behavior of the target's motion it is possible to automatically identify when the target has been downed freeing the system seek the next target.

A major objective of this invention relates to the ability of the laser-based interceptor to minimize and tailor the hazard zone it enforces. As describe above the selection of a LWIR wavelength together with a large-aperture, steeply converging illumination beam minimizes the hazard range in the direction of the laser beam behind the target aimed upon. Typically the down-range hazard zone is limited to approx. twice the target range; for example a target shot at at 1 Km will endanger personnel down range a further 2 Km, or approx. 3 Km from the interceptor. While this is relatively small danger range a compared to other laser-based interceptors, this in itself is insufficient to allow operation of the interceptor in urban areas. To this basic capability we add several safety measures that can piecewise tailor the devices hazard footprint to a specific application scenario.

The tools available to tailor the hazard footprint are:

Hardware fixed angular operation limits: the system can be setup to exclude certain azimuth and elevation ranges using hardware limit switches and hard-stops to confine the angular range of each axis.

Software specified angular operation limits: the same as above but using software-controlled ranges. Such would typically allow higher resolution of the azimuth and elevation limits.

Software specified range limits: to limit the operable range of the device at certain azimuth and elevation values.

Software specified laser power limits: to limit the allowed laser power at certain azimuth and elevation values.

Man-in-the-loop identification of the target to be fired upon: the system requires a manual confirmation to fire, so that should a potential hazard occur, such that a person or equipment enter the file line, the operation can be aborted. Such operation can also be assisted with dedicated software that alert the operation to a dangerous situation.

Figure 10A:
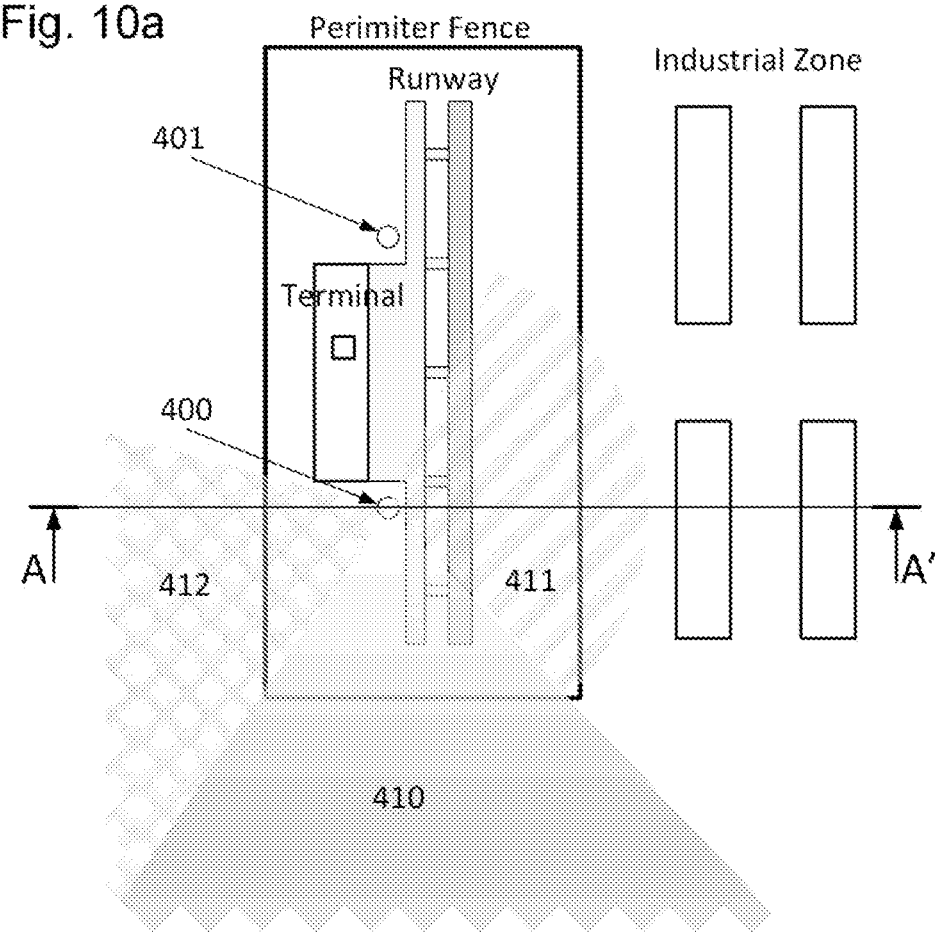
FIGS. 10*a* and 10*b* schematically show a plan and elevation cross-section, respectively, of a piecewise construction of a limited hazard zone for safe operation of a laser-based interceptor for soft and other low-flying airborne devices according to embodiments of the current invention in an urban area.
Figure 10B:
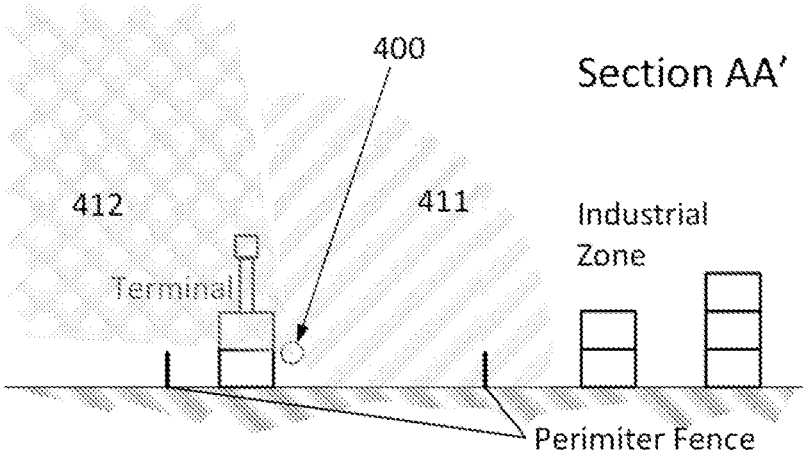

Using these tools it is possible to define a complex hazard footprint for a specific setup. FIGS. 10*a* and 10*b* show schematically such a piecewise setup at an airport with a plan view and a cross-section view, respectively. A laser interceptor, 400, is located such that is can intercept targets with no limitation along the direction of the runway. This region is marked 410 in the plan view (FIG. 10*a*) extending between two specified azimuth values and allowing the full elevation within these values. These are software limits. There is no limitation on firing in segment 410 as there is no personnel nor equipment identified in it. Still there is danger that the system will fire on approaching or taking off aircraft. This is prevented by the manual verification that there are no such aircraft in the line-of-fire. Even if initially laser had been set on, the much higher damage level of aircraft allows the operators several seconds to correct the situation. It is clear that approval of such a procedure would require use of dual, independent systems for increased reliability.

In segment 411, the system is setup to be power and range limited to ensure that personnel in the nearby industrial zone are not endangered. This would entail a shorter effective operation range for the system, but would still allow coverage of a large portion of the runway.

In segment 412 there are no limitations on firing above the height of personnel, so in this segment the system is limited by hardware as well as software limits, and can engage any targets that fly over the perimeter fence.

As indicated above, it is unlikely that large sites such as an airport can be covered by a single laser interceptor. Here there is located a second interceptor 401, that in this example, can complement interceptor 400 to cover the entire airport.

The description of the above embodiments is not intended to be limiting, the scope of protection being provided only by the appended claims.

The invention claimed is:

1. A localized laser-based interceptor system for low flying or plastic targets, the system comprising: a) two or more MWIR or LWIR lasers aligned to generate two or more laser beams with different polarization states; b) two or more large aperture optical beam delivery systems, each of the two or more large aperture optical beam delivery systems configured for converting each of the laser beams into an adjustable beam converging to a minimal spot on a target of the low flying or plastic targets and further propagating in a divergent manner, wherein each of the optical beam delivery systems is configured to adjust a focal distance and a spot size on the target, whereby the spot size is adjustable for optimal damage performance on the target, as a function of the distance from the target, the velocity of the target across the laser beam spot, and whereby the minimal spot on the target results in a reduced danger zone for personnel and equipment, due to fast expansion of the laser beam beyond the target's location.

2. The system of claim 1, further comprising a target designating unit configured for determining a distance, velocity or direction of the low-flying target.

3. The system according to claim 2, wherein the target designating unit comprises at least one camera configured for recognizing the low flying target.

4. The system according to claim 3, wherein recognizing of the low flying target is at least partially based on deep learning algorithms.

5. The system according to claim 2, wherein the target designating unit comprises at least one aiming camera.

6. The system according to claim 2, wherein said target designating unit comprises at least two aiming cameras for cooperatively determining a direction and distance to the low flying target.

7. The system according to claim 2, wherein the target designating unit comprises at least one infrared camera.

8. The system according to claim 1, further comprising a platform provided with leveling jacks configured for levelling and stabilizing said platform.

9. The system according to claim 8, wherein the platform is mountable on a self-propelled vehicle.

10. The system of claim 1, wherein the low flying targets comprise kites, balloons or unmanned aerial vehicles (UAVs).

11. A localized laser-based interceptor system for low flying or plastic targets, the system comprising: a) two or more MWIR or LWIR lasers aligned to generate two cross polarization laser beams; b) two or more large aperture optical beam delivery systems with adjustable focal distances, spot sizes and angular offsets of the output beams, each of the two or more large aperture optical beam delivery systems are configured for converting the laser beams into adjustable beams converging to a minimal spot on a target of the low flying or plastic targets and further propagating in a divergent manner, whereby the spot-size of each of the two or more beam is adjustable for optimal damage performance on the target as a function of the distance from the target, the velocity of the target across the laser beam spot, and whereby the relative convergence of the two or more beams is adjusted so that their spots overlap on the target.

12. The system of claim 11, further comprising a target designating unit configured for determining a distance, velocity or direction of the low-flying target.

13. The system according to claim 12, wherein the target designating unit comprises at least one camera configured for recognizing the low flying target.

14. The system according to claim 13, wherein recognizing of the low flying target is at least partially based on deep learning algorithms.

15. The system according to claim 12, wherein the target designating unit comprises at least one aiming camera.

16. The system according to claim 12, wherein the target designating unit comprises at least two aiming cameras for cooperatively determining a direction and distance to the low flying target.

17. The system according to claim 12, wherein the target designating unit comprises at least one infrared camera.

18. The system according to claim 11, further comprising a platform provided with leveling jacks configured for levelling and stabilizing said platform.

19. The system according to claim 18, wherein the platform is mountable on a self-propelled vehicle.

20. The system of claim 11, wherein the low flying targets comprise kites, balloons or unmanned aerial vehicles (UAVs).

* * * * *